United States Patent [19]

Morita

[11] 4,271,399

[45] Jun. 2, 1981

[54] DIELECTRIC RESONATOR FOR VHF TO MICROWAVE REGION

[75] Inventor: Hideo Morita, Tokyo, Japan

[73] Assignee: Nippon Electric Co., Ltd., Tokyo, Japan

[21] Appl. No.: 32,822

[22] Filed: Apr. 24, 1979

[30] Foreign Application Priority Data

Apr. 24, 1978 [JP] Japan ..... 53/48954

[51] Int. Cl.[3] ..... H01P 7/10

[52] U.S. Cl. ..... 333/219; 333/202; 333/226

[58] Field of Search ..... 333/202, 219, 222, 224, 333/226

[56] References Cited

U.S. PATENT DOCUMENTS

| | | | |
|---|---|---|---|
| 3,668,574 | 6/1972 | Barlow | 333/219 X |
| 4,182,997 | 1/1980 | Brambilla | 333/202 X |

*Primary Examiner*—Paul L. Gensler

*Attorney, Agent, or Firm*—Sughrue, Rothwell, Mion, Zinn and Macpeak

[57] ABSTRACT

A high frequency miniaturized dielectric resonator is disclosed. The resonator includes an elongated dielectric member axially hollow at least in part of its cross section. A conductor surrounds the dielectric member, and a metal rod is inserted into the hollowed part of the dielectric member and coupled to the conductor. This structure supports resonance in a hybrid mode including the TEM mode and the $TE_{10g}$ mode (g being a positive number).

5 Claims, 12 Drawing Figures

FIG 5A
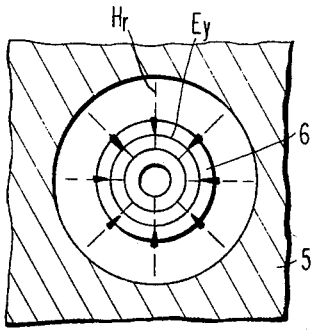
FIG 5B
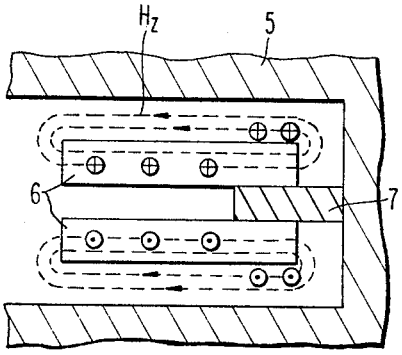
FIG 5C
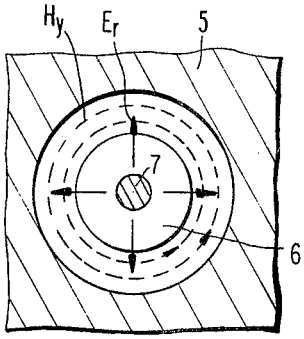
FIG 6A
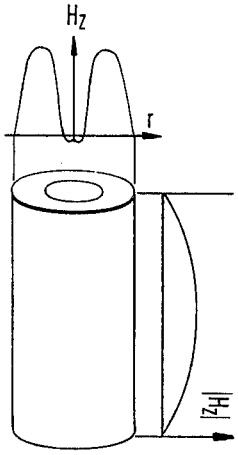
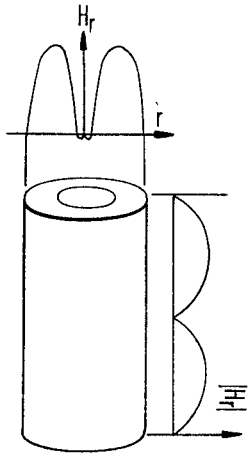
FIG 6B
FIG 7
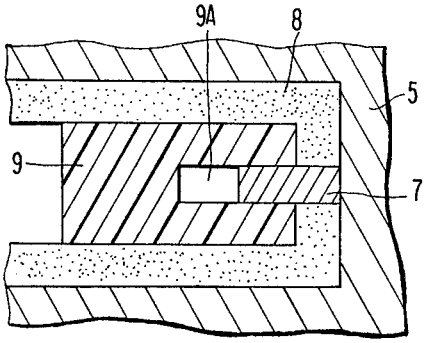
FIG 8
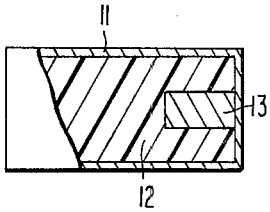

DIELECTRIC RESONATOR FOR VHF TO MICROWAVE REGION

BACKGROUND OF THE INVENTION

The present invention relates to miniaturized dielectric resonators for VHF to microwave regions (30 MHz to 10 GHz, referred to hereunder as a high frequency region) and, more particularly, to a resonator of this kind featured by low loss even when the dielectric constant of the resonator is high.

High dielectric constant ceramics with low loss and high stability have recently been in use to miniaturize high frequency apparatus and to improve its reliability. Particularly, the trend toward the extensive use of integrated circuits has accelerated the development of highly miniaturized narrow-band, low-loss bandpass filters, which can be composed of strip lines formed on a ceramic substrate of a high dielectric constant. (For details, reference is made to T. D. Iveland, "Dielectric Resonator Filters for Application in Microwave Integrated Circuits," published in *IEEE Trans. on Microwave Theory and Techniques* Vol. MTT-19, No. 7, pages 643 to 652, July 1971). The conventional dielectric resonators for the high frequency region are generally classified as a coaxial dielectric resonator and a circular cylindrical or rectangular parallelepiped dielectric resonator. (Reference is made to J. C. Sethares et al, "Design of Microwave Dielectric Resonators", *IEEE Trans. on Microwave Theory and Techniques,* Vol. MTT-14, No. 1, pages 2 to 7, January 1966). The circular cylindrical or rectangular parallelepiped dielectric resonator is particularly suited for miniaturized resonators of high unloaded Q for the frequency range from several GHz to 10 GHz. In contrast, this type of resonator is difficult to miniaturize in the 300 MHz to 3 GHz region if a comparable unloaded Q is desired to be maintained. The coaxial dielectric resonator for the UHF region is easier to miniaturize but it is difficult to maintain high unloaded Q values.

SUMMARY OF THE INVENTION

Accordingly, an object of the invention is to provide a high frequency dielectric resonator free from the above-mentioned shortcomings of conventional resonators.

According to the invention, there is provided a dielectric resonator comprising: an elongated dielectric member axially hollow at least in part; a conductor covering the dielectric member; and a metal rod inserted into the hollow part of the dielectric member and connected to the conductor, whereby resonance of electromagnetic waves is observed for the TEM mode and the $TE_{10g}$ mode (g is a positive number).

BRIEF DESCRIPTION OF THE DRAWINGS

Other objects and features of the invention will be apparent from the following description taken in connection with the accompanying drawings, in which:

FIGS. 5A, 5B and 5C are cross sectional views taken on lines A—A', B—B' and C—C' in FIG. 4, and the electro-magnetic field in these cross sections;

FIGS. 6A and 6B show magnetic field distributions in $TE_{10g}$ mode of a ring-shaped dielectric resonator useful in explaining the present invention;

FIG. 7 shows a cross sectional view of another embodiment of the present invention; and FIG. 8 shows partly in cross section still another embodiment of the present invention.

DESCRIPTION OF THE PRIOR ART

Figure 1:
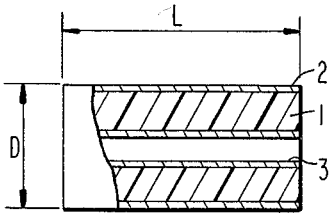
FIG 1 PRIOR ART
FIG. 1 shows partly in cross section a conventional TEM mode coaxial dielectric resonator.

Reference is first made to FIG. 1 illustrating a conventional coaxial dielectric resonator. In the figure, a dielectric material 1 such as barium titanate ceramic is covered with an outer conductor 2 and an inner conductor 3. The resonator resonates in TEM mode at a resonance wavelength $\lambda_o$. The resonance wavelength $\lambda_o$ is $$\lambda_o = 1/\sqrt{\epsilon_r} \times L/2$$

where L is the length of the resonator and $\epsilon_r$ is the relative dielectric constant. When the diameter D of the resonator is 10 mm and the frequency is 1 GHz, the unloaded Q is approximately 1000. If such a resonator is used in a narrow band-pass filter for about 1 GHz, its insertion loss is so large that the filter finds a very limited application.

Figure 2:
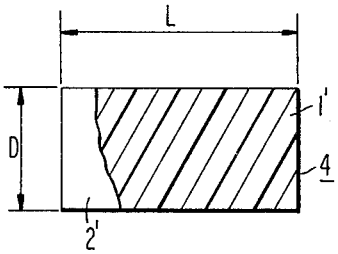
FIG 2 PRIOR ART
FIG. 2 shows partly in cross section a $TE_{10g}$ mode circular cylindrical dielectric resonator.
Figure 3A:
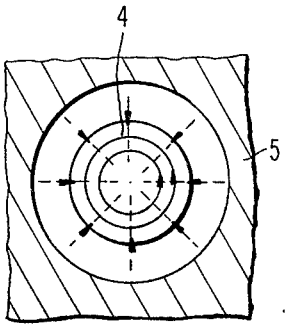
FIGS. 3A and 3B show electromagnetic field vector diagrams of the resonator shown in FIG. 2.
Figure 3B:
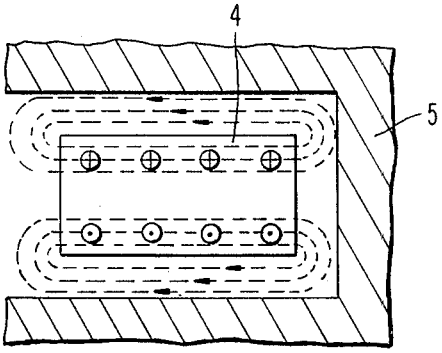

Turning now to FIG. 2, there is shown another conventional circular cylindrical dielectric resonator. Reference numeral 2' denotes an outer conductor; and 1', dielectric material. When this type of resonator operates in the $TE_{10g}$ mode, the electromagnetic field vector diagrams are illustrated as shown in FIGS. 3A and 3B. In the figures, the circular cylindrical dielectric resonator 4 is surrounded by an external metal case 5. The electric field vector is indicated by solid lines and the magnetic vector diagram by broken lines. The resonance wavelength $\lambda_o$ in the $TE_{10g}$ mode, the diameter D and the length L of the resonator are related as follows:

$$\beta_d \tan(\beta_d \times L/2) = \alpha_a$$

where $$\beta_d = 2\sqrt{(\epsilon r/\lambda_o^2) - (0.586/D^2)},$$

$$\alpha_a = 2\pi\sqrt{(0.586/D^2) - (1/\lambda_o^2)}.$$

The relative dielectric constant $\epsilon_r$ of the dielectric material is, for example, about 40 in high frequencies in the case of ceramic of barium titanate. (Reference is made to S. B. Cohn, "Microwave Bandpass Filter Containing High-Q Dielectric Resonators", *IEEE Tran. Microwave Theory and Techniques,* Vol. MTT-16, No. 4, pages 218 to 227, April 1968). When this circular cylindrical dielectric miniaturized resonator is operated at several GHz to 10 GHz, the unloaded Q is 6000 to 10000 (D=10 mm and L=3 to 15 mm). Therefore, this resonator is practically usable. However, when it is used in the same mode at the frequency 1 GHz, its size needs to be great enough to achieve a comparable high value for the loaded Q. This is detrimental to the miniaturization or integration of the device.

DESCRIPTION OF THE PREFERRED EMBODIMENTS

Figure 4:
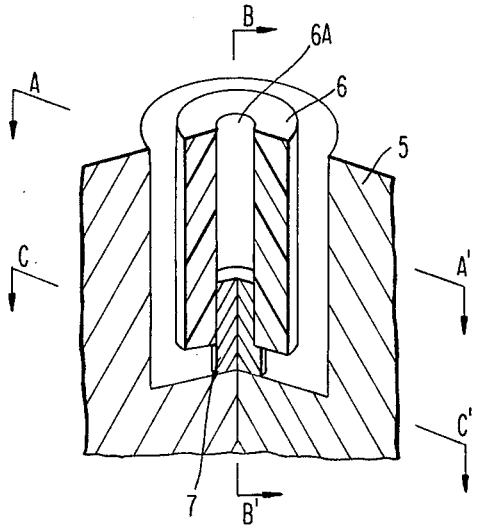
FIG. 4 shows a cross sectional view of an embodiment of the present invention.

Turning now to FIG. 4, showing a dielectric resonator of the present invention, a metal rod 7 is partially inserted into a hollow 6A axially formed in a ring shaped dielectric member 6. With such an arrangement, the resonator operates in an intermediate mode (referred to as a hybrid mode) between the $TE_{10g}$ mode and the TEM mode. The ring-shaped dielectric resonator shown in FIGS. 6A and 6B exhibits an invariation of the resonance frequency with respect to the change in the inner diameter d in $TE_{10g}$ mode, when $d/D<0.4$, where D is the outer diameter of the resonator. This fact is described in a paper titled "Coaxial Type Microwave Bandpass Filter Containing Dielectric Resonators" by Wakino Kikuo et al, published in the *Proceedings of the Institute of Electronics and Communication Engineers of Japan,* MW75-9, Page 3. Reference is particularly made to FIG. 3. As is known, when a metal member is inserted into a cavity, the amount of magnetic energy contained in a volume defined by the metal member is larger than the electric energy. The resonance frequency in the cavity therefore becomes higher. Conversely, when the amount of magnetic energy is smaller than that of the electric energy, the resonance frequency becomes low. An electric field vector Ez along the central axis of the resonator and an electric field vector Er directed toward the central axis in the ring-shaped portion of the dielectric resonator are related by $Ez=Er=0$ because of the existance of only the field vector $E\phi$ around the ring-shaped portion. This will be seen from FIGS. 5A and 5B.

As seen from FIGS. 6A and 6B, a magnetic field Hz along the axis of the resonator has a distribution with the minimum at the central part. This is true for a magnetic field Hr directed toward the central axis. Accordingly, in the ring-shaped portion of the dielectric resonator, only an electric field vector $E\phi$ around the ring-shaped portion exists in the vicinity of the axis. More specifically, when the ring-shaped resonator is in electromagnetic resonance in the $TE_{10g}$ mode, the electric energy in the vicinity of the axis is larger than the magnetic energy.

When the metal rod 7 is inserted into the cavity portion, it pushes aside the electric field $E\phi$ so that the frequency gradually lowers. With increased insertion of the metal rod 7, the TEM mode becomes dominant because the electric field Er and a magnetic field $H\phi$ arise while the magnetic field Hr disappears in the section with the metal rod 7 inserted as shown in FIGS. 5B and 5C. Therefore, the resonance frequency is determined by this mode. In the dielectric resonator with this construction, mode and current loss are both intermediate between those in the TEM mode and the $TE_{10g}$ mode, with the result that the unloaded Q and the size of the resonator also become intermediate. Therefore, this resonator is practicable particularly in the UHF region. For example, when the resonator with the diameter $D=20$ mm and the axial length $L=15$ mm is used at the resonance frequency 1 GHz, the unloaded Q is 4000 to 5000, that is to say, this value is very desirable.

Turning now to FIG. 7, the dielectric resonator of the present invention constitutes a filter. In the figures, a cylindrical dielectric member 9 is axially hollow (with axial bore 9A) at least in part. The dielectric member 9, covered with a supporting member 8 made of material with a low dielectric constant and a low loss such as Teflon, or Rexolite manufactured and marketed by American Enka Inc., is fastened to the external metal case 5 by means of the supporting member 8. A metal rod 7 is slidably inserted into the bore 9A, with the other end portion extending into the supporting member 8. With such a construction, the resonance frequency may be changed widely by changing the insertion length of the metal rod 7.

In the example shown in FIG. 8 the outer conductive layer 11 is formed by vapor deposition of conductive material such as silver, which is deposited over a dielectric member 12, for the purpose of further miniaturization of the device. A metal rod 13 is fixed onto the bore formed in the dielectric member 12.

As described above, the present invention, provides a miniaturized high-Q dielectric resonator made of low-loss, high-Q, high dielectric constant material and operable even in the UHF region. It will be noted that the dielectric resonator of the present invention is applicable to miniaturized bandpass filters. Also, it should be understood that the dielectric resonator of the present invention may be not only of circular type but also of rectangular parallelepiped type.

What is claimed is:

1. A dielectric resonator comprising: an elongated dielectric member axially hollow at least in part of its cross section; a conductor surrounding said dielectric member; and a metal rod inserted into the hollow part of said dielectric member and coupled to said conductor, said metal rod having a length shorter than said hollow part, leaving a part of the overall length of said dielectric member without said rod inserted, so that resonance is supported in the TEM mode and the $TE_{10g}$ mode (g is a positive number) at said part of said overall length.

2. A dielectric resonator as claimed in claim 1 wherein said conductor consists of a thin layer formed by metalization of the surface of said dielectric member.

3. A dielectric resonator as claimed in claim 1 wherein said dielectric member is supported at a distance from said conductor.

4. A dielectric resonator as claimed in claim 3 wherein said metal rod supports said dielectric member.

5. A dielectric resonator as claimed in claim 3 wherein said dielectric member is supported by a low loss, low dielectric constant material filling the space between said dielectric member and said conductor.

* * * * *